US010593532B2

(12) United States Patent
Gebhardt et al.

(10) Patent No.: US 10,593,532 B2
(45) Date of Patent: Mar. 17, 2020

(54) LIQUID JUNCTION APPARATUS FOR ELECTROSPRAY IONIZATION

(71) Applicants: Bruker Daltonik GmbH, Bremen (DE); Peter Aagaard Nielsen, Marslev (DK)

(72) Inventors: Christoph Gebhardt, Bremen (DE); Peter Aagaard Nielsen, Marslev (DK); Ralph Kikillus, Bremen (DE); Christian Meier-Credo, Bremen (DE)

( * ) Notice: Subject to any disclaimer, the term of this patent is extended or adjusted under 35 U.S.C. 154(b) by 0 days.

(21) Appl. No.: 16/278,502

(22) Filed: Feb. 18, 2019

(65) Prior Publication Data

US 2019/0259597 A1 Aug. 22, 2019

(30) Foreign Application Priority Data

Feb. 19, 2018 (DE) ..... 10 2018 103 609

(51) Int. Cl.
*H01J 49/16* (2006.01)
*H01J 49/26* (2006.01)

(52) U.S. Cl.
CPC ..... *H01J 49/167* (2013.01); *H01J 49/26* (2013.01)

(58) Field of Classification Search
CPC ..... H01J 49/167; H01J 49/26
See application file for complete search history.

(56) References Cited

U.S. PATENT DOCUMENTS 9,134,283 B2 9/2015 Hochgraeber et al.
9,671,048 B2 6/2017 Graham et al.
2005/0092917 A1 5/2005 Hirabayashi et al.
2008/0315083 A1 12/2008 Lubda et al.
2017/0025262 A1 1/2017 Xu et al.

FOREIGN PATENT DOCUMENTS

CN 203176125 U 9/2013
CN 105605071 A 5/2016
EP 2388797 A1 11/2011
(Continued)

OTHER PUBLICATIONS

Gelpi, F, "Interfaces for coupled liquid-phase separation/mass spectrometry techniques. An update on recent developments", J. Mass Specrom. 2002; vol. 37: pp. 241-253.
(Continued)

*Primary Examiner* — Nicole M Ippolito
*Assistant Examiner* — Hanway Chang
(74) *Attorney, Agent, or Firm* — Benoit & Côté Inc.

(57) ABSTRACT

The invention relates to a liquid junction apparatus for electrospray ionization in a mass spectrometer comprising an electrospray emitter, a capillary conduit assembly for conducting liquid to be electrosprayed, and a union comprising an electrically conductive material, in which the electrospray emitter and the capillary conduit assembly are accommodated in a bottom-sealing butt joint featuring low dead volume while retaining at least one of them pluggable and withdrawable. The liquid junction apparatus facilitates energizing the transmitted liquid to a predetermined voltage level at the liquid junction upstream of an actual emitter tip where electrospraying occurs, while retaining at least one of an electrospray emitter and a capillary conduit assembly pluggable into and withdrawable from a union that comprises a conductive material.

20 Claims, 6 Drawing Sheets

(56) References Cited

FOREIGN PATENT DOCUMENTS

| | | | |
|---|---|---|---|
| WO | 2009123415 | A1 | 10/2009 |
| WO | 2014147404 | A1 | 9/2014 |

OTHER PUBLICATIONS

Schmitt-Kopplin et al., "Capillary electrophoresis—mass spectrometry: 15 years of developments and applications", Electrophoresis 2003, vol. 24, pp. 3837-3867.

Bonvin, G et al., "Capillary electrophoresis—electrospray ionization-mass spectrometry interfaces: Fundamental concepts and technical developments", Journal of Chromatography A, 2012, vol. 1267, pp. 17-31.

Deininger, S. O. et al., Normalization in MALDI-TOF imaging datasets of proteins: practical considerations, Anal Bioanal Chem., 2011, vol. 401, pp. 167-181.

LIQUID JUNCTION APPARATUS FOR ELECTROSPRAY IONIZATION

BACKGROUND OF THE INVENTION

Field of the Invention

The invention relates generally to a liquid junction apparatus for electrospray ionization in a mass spectrometer, such as one that transmits a liquid eluent from a liquid chromatograph (LC) or a capillary electrophoresis (CE) device to an electrospray ionization (ESI) source.

Description of the Related Art

Various design solutions for liquid junction apparatuses in general exist in the state of the art, a selection thereof being summarized in the following:

The review by E. Gelpí (J. Mass Spectrom. 2002; 37: 241-253) shows schematics of possible arrangements for an electrospray ionization liquid junction interface, one of which includes the application of high voltage via a metal sleeve in contact with a liquid junction gap. Further, a MicroESI interface is mentioned where an inlet capillary is connected to the ESI tip by means of a stainless-steel sleeve, where the high voltage is applied to the stainless-steel sleeve in contact with a glass-fiber frit placed between the two capillaries.

The review by P. Schmitt-Kopplin et al. (Electrophoresis 2003, 24, 3837-3867) elaborates on different concepts for ESI interfaces, one of which encompasses a sheathless interface with electrical contact at the border between a separation capillary and the sprayer tip.

The review by G. Bonvin et al. (Journal of Chromatography A, 1267 (2012) 17-31) describes methods for creating electrical contact with sheathless interfaces in capillary electrophoresis to spray tip fittings, one of which comprises a junction with a metal sleeve.

The utility model CN 203176125 U pertains to the technical field of capillary gas chromatography and describes a capillary column rapid-replacing nut of a gas chromatograph, which is characterized in that an elongate cut-out with a width of one millimeter is machined in the lateral surface of the nut along its whole length so that a capillary column with a diameter less than one millimeter can be inserted into or withdrawn from the nut laterally.

The patent application publication CN 105605071 A presents a chromatographic column auxiliary mounting nut having a likewise slitted cylindrical body for the lateral insertion of a capillary column into and withdrawal from the nut.

The U.S. Pat. No. 9,134,283 B2 relates to a plug unit for connecting capillary tubes, especially for high-performance liquid chromatography and further to a connection system consisting of a bushing unit and a plug unit.

The U.S. Pat. No. 9,671,048 B2 relates to fitting assemblies and fluidic connection systems, such as those used in connecting components of liquid chromatography systems and other analytical instrument systems, and, more specifically, to manifold connection assemblies, valves, and fluidic connection systems for connecting tubing to manifolds.

In view of the above, there is still a need for improvement with electrospray emitters interfaced with capillary conduits, such as in connections of an exit of a liquid substance separator to the electrospray emitter. Further objectives and achievements of the invention will readily suggest themselves to those of skill in the art upon reading the following disclosure.

SUMMARY OF THE INVENTION

The invention relates generally to a liquid junction apparatus for electrospray ionization (ESI), for instance for connecting a liquid supply to an ESI source in a mass spectrometer, comprising (i) an electrospray emitter having a liquid-entrance end which is fluidly connected via an electrospray emitter conduit, such as a non-conductive conduit, e.g. a fused silica capillary, to an emitter tip, from which liquid can be electrosprayed, the liquid-entrance end comprising an encasing with a conductive sheath, (ii) a capillary conduit assembly for conducting liquid to be electrosprayed that bottom-seals against the conductive sheath, and (iii) a union comprising an electrically conductive material and having a first side and a second side, the first side being designed and configured with a first opening to partially accommodate the electrospray emitter and the second side being designed and configured with a second opening to accommodate the capillary conduit assembly such that an exit of the capillary conduit assembly is positioned in opposing relation to the liquid-entrance end of the electrospray emitter to form a butt joint which facilitates transmitting liquid from the capillary conduit assembly to the electrospray emitter such that electrical contact of the liquid with the conductive sheath is established, wherein the union is connected to a voltage source and the conductive sheath is in electrical contact with the union such that the liquid at the butt joint is maintained at a predetermined electrical voltage level, such as in the kilovolts range or at ground, to facilitate electrospraying.

In various embodiments, the capillary conduit assembly may comprise a capillary column. In alternative embodiments, the capillary conduit assembly may comprise a transfer line and the electrospray emitter may comprise a packed emitter assembly including a capillary column.

In various embodiments, the butt joint can encompass a slight gap between the exit of the capillary conduit assembly and the liquid-entrance end of the electrospray emitter conduit so as to facilitate the electrical contact of liquid with the conductive sheath (while however maintaining the bottom seal at least at the radially outer circumference of the interface plane). Preferably, the gap is defined by a beveled liquid-entrance end of the electrospray emitter conduit, or by the electrospray emitter conduit being slightly retracted into the surrounding conductive sheath. Another variant foresees the electrospray emitter conduit and the conductive sheath with a flush bond, while at the same time providing a rear face of the electrospray emitter conduit with a roughened surface, such as containing grooves and/or furrows, that allows liquid to creep from the interior of the conduits up to the conductive sheath. Generally, the conductive sheath may encase the liquid-entrance end of the electrospray emitter conduit one of flush and slightly protruding therefrom. In all the aforementioned variants and as a general principle within the context of the present disclosure, the electrospray emitter and the capillary conduit assembly stay in abutting contact at least at the radially outer circumference of the interface plane to establish and maintain the bottom sealing.

In various embodiments, the conductive sheath may comprise conductive tubing. In particular, the conductive sheath has an inherently shape-preserving, rigid structure requiring a certain thickness of at least a third of a millimeter, such as half a millimeter or 600 micrometers or even greater, and is thus to be distinguished from a mere coating of the liquid-entrance end of the electrospray emitter conduit with a conductive layer applied, e.g., by vapor deposition or electrolytic deposition which would have only a few ten micrometers at most. Generally, the conductive sheath may be made from metal, such as stainless steel. For example, it can encompass a metallic cylindrical stub. Other possible materials would include forming the conductive sheath from conductive plastics.

Standard fused silica conduits having typical outer diameters of 150, 280, or 360 micrometers can be used for the electrospray emitter conduit but also for the capillary conduit to be connected. Various diameters can be glued into a conductive sheath taking the shape of a metallic tubing stub of slightly larger inner diameter and typical outer diameter of 1.6 millimeter (1/16"), for instance. The end face of the fused silica conduit is preferably flush with the end surface of the metallic tubing stub or slightly retracted there-into, as set out before.

The smooth metallic end face of this particular embodiment of a conductive sheath provides an optimal sealing interface for bottom-sealing connection systems (butt joints), wherein bottom-sealing means in particular that the sealing is effected generally in an interface plane perpendicular to the axis of the liquid junction apparatus at the position where the opposing electrospray emitter and capillary conduit assembly abut. The conductive character of the sheath allows electrical contact, as the fluid in the conduits to be connected wets the end face of the electrospray emitter conduit and thusly electrically contacts the encasing sheath.

In various embodiments, the liquid-entrance end of the electrospray emitter conduit can engage with and be adhesively bonded to the conductive sheath, such as by using glue. In one embodiment, a leak-tight connection between a fused silica conduit and a metal sheath is achieved by substantially full-face contact gluing. Alternatively, to facilitate the gluing, it is possible to add a perpendicular slit close to an end face of the conductive sheath opening up the axial channel with the fused silica. If glue is applied there instead of at the front face, contamination of the front face can be avoided. Compared to applying glue from the back side of the conductive sheath, small tubular dead volumes are avoided. Instead of a tubular geometry the conductive sheath can have a disk-like geometry. In such case, the disk can be glued from the back face of the disk. Alternatively, the inner and outer cylindrical surfaces can be mechanically joined by plastic deformation or heat shrinking.

To establish a connection, the conductive sheath can be placed inside a reusable union into which a bottom-sealing capillary conduit assembly is screwed, or otherwise locked. Alternatively, conductive sheath and union could be combined into a single piece into which the fused silica is glued.

In one embodiment, an axial slit in the union allows inserting the electrospray emitter laterally and through the second opening while the first opening may be dimensioned merely to accommodate the comparatively lean electrospray emitter conduit. Alternatively, the conductive sheath can be fixed in a through-hole union by screwing or otherwise locking a standard (fixation) nut in from one side and the bottom seal fitting from the other.

In various embodiments, the capillary conduit assembly can comprise a non-conductive jacket encasing an exit region of a capillary conduit. The non-conductive jacket may be generally cylindrical but can also have a trumpet-shape in some implementations. Preferably, the non-conductive jacket comprises an elastomeric material to facilitate effective sealing. In the afore-described structure, the front face of the non-conductive jacket may serve as sealing element of the capillary conduit which seals against the rear face of the conductive sheath. The necessary sealing force may be applied directly or indirectly by some forward shoulder of the conductive sheath in an upstream direction and/or backward shoulder of the capillary conduit assembly in a downstream direction, for example. The sealing force can act substantially axially with respect to the abutting conduits and press electrospray emitter and capillary conduit assembly together.

In various embodiments, at least one of the electrospray emitter and the capillary conduit assembly can be inserted into and withdrawn from the first and second opening, respectively, head-on. Preferably, at least one of the first and second openings can comprise an interlocking mechanism which may encompass a screw joint, bayonet joint, or the like. Generally, at least one of the electrospray emitter and the capillary conduit assembly is pluggable into and withdrawable from the union.

In various embodiments, the electrospray emitter can further comprise a ferrule mounted about the conductive sheath, such as by the application of an adhesive or a friction/crimp fit. In some circumstances it might be of advantage to produce the ferrule and the conductive sheath structures as a single unified part, such as a single-piece part formed from a block of a single material (e.g. metal). The ferrule may comprise electrically conductive material which is electrically contacted by the union upon insertion, too. Also, a fixation nut can be foreseen which may be designed and configured to partially accommodate and fixate the electrospray emitter in the first opening of the union via pressurizing the ferrule.

In various embodiments, the union can comprise a slit extending along its entire length, the width of which may facilitate lateral insertion and withdrawal of the electrospray emitter conduit. Preferably, the first opening may be confined radially by an inward-reaching shoulder dimensioned such as to facilitate neat accommodation of the electrospray emitter conduit, and wherein the shoulder can provide for a contact surface with which a front face of the conductive sheath engages when the electrospray emitter has been inserted into the union.

In various embodiments, the capillary conduit assembly can be connected upstream to a substance separator, such as a liquid chromatograph or a capillary electrophoresis device, in order to receive sample liquid of pre-separated analyte content therefrom.

In various embodiments, the union can be made from a conductive material, such as metal, stainless steel for example.

BRIEF DESCRIPTION OF THE DRAWINGS

The invention can be better understood by referring to the following figures. The elements in the figures are not necessarily to scale, emphasis instead being placed upon illustrating the principles of the invention (often schematically).

DETAILED DESCRIPTION

While the invention has been shown and described with reference to a number of different embodiments thereof, it will be recognized by those of skill in the art that various changes in form and detail may be made herein without departing from the scope of the invention as defined by the appended claims.

Figure 1A:
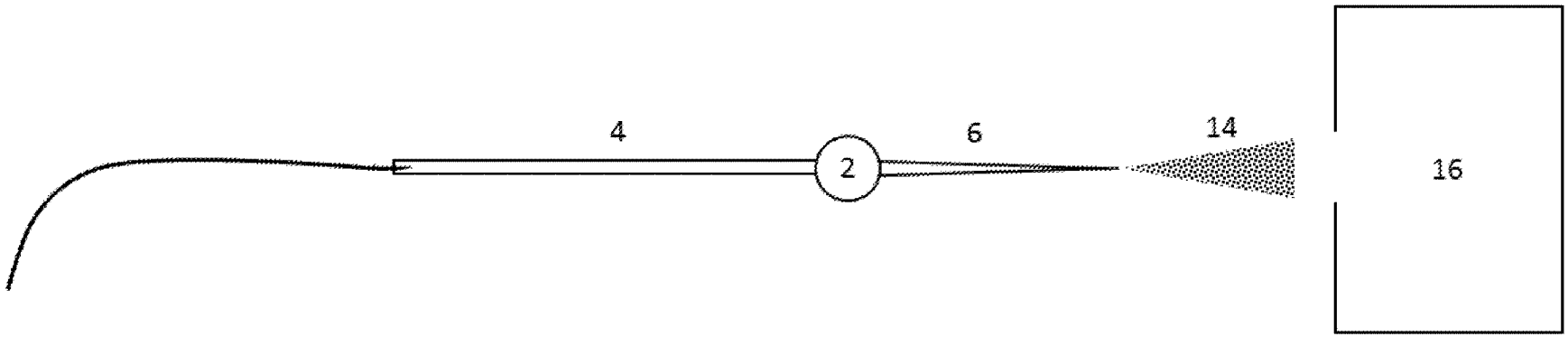
FIGS. 1A and 1B illustrate examples of a point of electrical contact with a voltage source in a liquid junction apparatus.
Figure 1B:
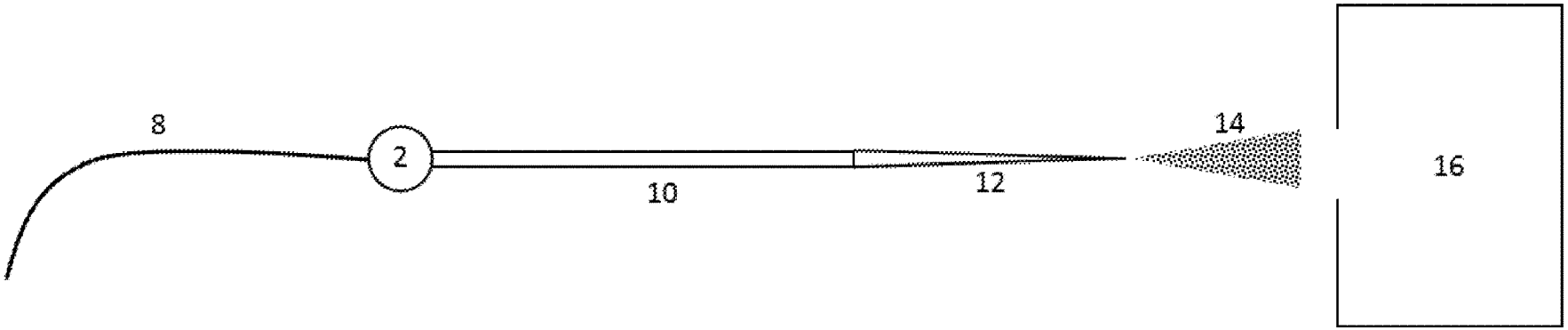

When running an ESI source with a capillary conduit, such as a chromatographic column, connected to an ESI emitter or just encompassing the chromatographic column, as is the case with a packed emitter, the mobile phase needs to have contact with either high voltage or ground to create the difference in electric potential in relation to a counter-electrode, thereby facilitating electrospraying. As illustrated in FIG. 1A, the usual contact point 2 for the voltage source is made between the conduit 4 and the emitter 6 or, as shown in FIG. 1B, in the case of a packed emitter including an emitter tip 12, between the transfer line 8 and the column 10. The electrosprayed and ionized sample molecules 14 are then introduced into the low pressure compartments 16 of a subsequent mass spectrometric analyzer, such as a time-of-flight analyzer, a triple quadrupole analyzer, an ion trap, an ion cyclotron resonance cell and the like. Introduction of electrosprayed ions into an ion mobility analyzer, such as a trapped ion mobility analyzer (see e.g. U.S. Pat. No. 7,838,826 B1), which may be further coupled to one of the aforementioned mass analyzers, would also be possible.

A critical part in getting good chromatographic performance (or substance separator performance in general) is the connection between the capillary conduit and the electrospray emitter. If this connection comprises a dead volume, the chromatographic performance can be adversely affected by broadening and/or tailing of elution peaks. Broad peaks and peak tailing however lower the possibility of getting reliable peptide/protein identification due to signal overlap. By minimizing the volume between the electrospray emitter and an attached capillary conduit to almost zero, this critical problem in (liquid) chromatography and related substance separation techniques connected to the ion source of a mass spectrometer can be overcome. The resulting sharper peaks have the additional advantage of a better signal-to-noise ratio, and the absence of dead volume cavities typical for ferrule-based connections reduces potential carry-over between subsequent samples.

Figure 2A:
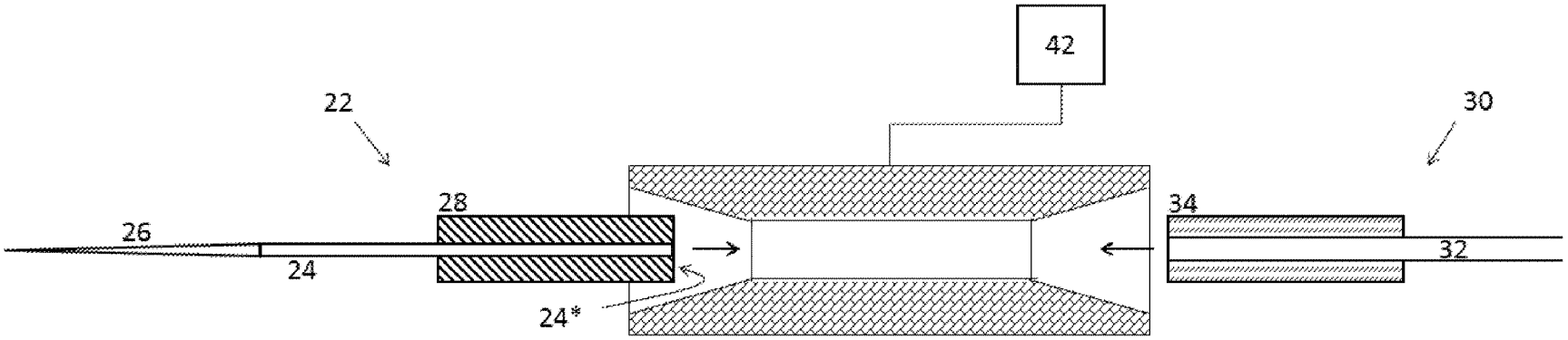
FIGS. 2A and 2B show an exemplary embodiment of a liquid junction apparatus according to principles of the invention.
Figure 2B:
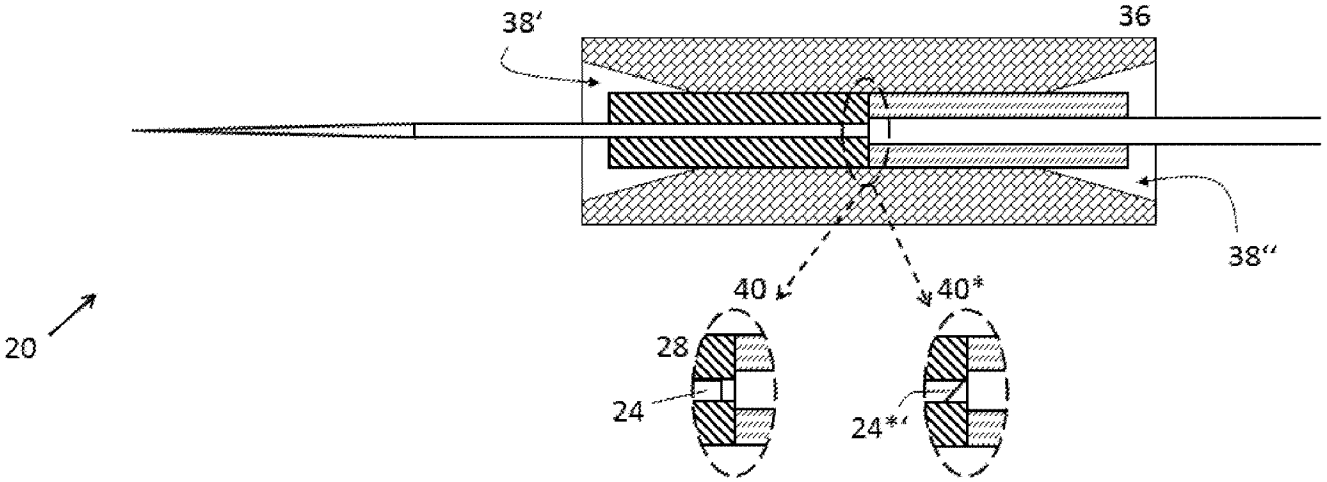

FIGS. 2A and 2B present a first example of a liquid junction apparatus 20 for electrospray ionization, FIG. 2A showing the apparatus in an unconnected state, and FIG. 2B showing it in a connected state. An electrospray emitter 22 has an emitter conduit 24, typically a fused silica capillary conduit, which terminates in a pointy emitter tip 26 from which sample liquid is to be electrosprayed (not indicated). The fused silica material renders the whole emitter conduit 24 from the liquid-entrance end 24* to the emitter tip 26 non-conductive in the example shown or, in other words, virtually not capable of transmitting electrical charge carriers. While metallic conduits may be used for the electrospray emitter 22, they may suffer from sample degradation due to active centers in the metallic walls. However, even metallic emitters are hard to contact electrically in ferrule-based connections. Also, in such circumstances, the connection via a conductive sheath presented here may prove advantageous.

The liquid-entrance end 24* of the emitter conduit 24 is encased in a conductive sheath 28 which can take the form of conductive tubing, such as metal tubing (e.g. stainless steel tubing). The conductive sheath 28 is preferably attached to the emitter conduit 24 via the opposing inner and outer cylindrical surfaces, respectively, using an adhesive, such as glue. The adhesive, optionally applied over the full-face contact, facilitates a liquid-tight connection between emitter conduit 24 and conductive sheath 28. Alternatively, the inner and outer cylindrical surfaces can be mechanically joined by plastic deformation or heat shrinking.

A capillary conduit assembly 30 for conducting liquid to be electrosprayed, in the example presented, comprises a capillary column 32 in which substances can be separated according to their elution time within a mobile phase that passes a stationary phase located in the column 32. The capillary conduit assembly 30 moreover features a non-conductive jacket 34, made of PEEK or another suitable thermoplastic polymer, encasing an exit region of the capillary column 32. The jacket 34 may in particular have the function of a front-face sealing element. It bottom-seals against the rear-face of the opposing conductive sheath 28 when the electrospray emitter 22 and the capillary conduit assembly 30 are pressed axially together by means of some axial force that is applied directly or indirectly via some backward or forward shoulder of the two assemblies 22, 30.

The liquid junction apparatus exemplified in FIGS. 2A and 2B further has a union 36 which comprises an electrically conductive material. It can be made completely from metal, such as stainless steel, for instance. It is constructed in a way that facilitates establishing electrical contact with the conductive sheath 28. The union 36 further has first and second sides, here facing away from one another to the left and right. The first side with a first opening 38' accommodates the electrospray emitter 22 which can be inserted from the side with the conductive sheath 28 head-on. The second side with a second opening 38" accommodates the capillary conduit assembly 30 which can likewise be inserted from the respective other side with the non-conductive jacket 34 head-on.

Each of the first and second openings 38', 38" includes a conical entrance part, in order to facilitate easier insertion, which connects to a straight hollow-cylindrical part at the center of the union 36 where the liquid-entrance end 24* of the electrospray emitter conduit 24 and the exit of the capillary conduit assembly 30 meet at an interface plane. The electrospray emitter 22 and the capillary conduit assembly 30 can be locked in the first and second openings 38', 38", respectively, by an interlocking mechanism provided at the straight hollow-cylindrical parts, such as a screw joint including opposing mating threads or bayonet joint including a pin-like protrusion and a helical opposite guiding groove (not shown). The interlocking mechanism exerts sufficient axial force on the capillary conduit assembly 30 and electrospray emitter 22 towards the interface plane so that the front face of the jacket 34 as sealing element of the capillary conduit assembly 30 bottom-seals against the opposing rear surface of the conductive sheath 28 in the example shown. When both the electrospray emitter 22 and the capillary conduit assembly 30 are inserted, they come to rest such that an exit of the capillary conduit assembly 30 is positioned in opposing relation to the liquid-entrance end 24* of the electrospray emitter conduit 24 to form a butt joint (lower panel).

The butt joint can be configured such that liquid, such as an eluent of an upstream substance separator (not shown), is transmitted from the capillary conduit assembly 30 to the electrospray emitter 22 while coming in electrical contact with the conductive sheath 28. This electrical contact between liquid and the conductive sheath 28 can be achieved in several ways. One example comprises bonding the emitter conduit 24 to the surrounding conductive sheath 28 such that the emitter conduit 24 is slightly retracted into the conductive sheath 28 (zoom-out 40). Another possibility provides for a beveled end face **24*' of the emitter conduit 24, thereby facilitating partial contact of the contained liquid with the surrounding conductive sheath 28 at least (zoom-out 40*). Yet another option (not illustrated) would be to arrange for the emitter conduit 24 and the conductive sheath 28 to be bonded flush, while at the same time providing the rear face of the emitter conduit 24 with a roughened surface, such as containing grooves and/or furrows, that allows liquid to creep from the interior of the conduit 24 up to the conductive sheath 28**.

The union 36 is (or at least the conductive parts thereof are) connected to a voltage source 42, and since the conductive sheath 28 is in electrical contact with the union 36 as well as with the liquid being transmitted through the conduits 24, 32, the liquid at the butt joint between electrospray emitter 22 and capillary conduit assembly 30 is maintained at a predetermined electrical voltage level by operating the voltage source 42 to facilitate electrospraying. The voltage level can be at ground or any other suitable high voltage value, such as in the kilovolts range, which would then suggest a different voltage applied to a counter-electrode of the electrospray emitter 22 (not shown) to establish the potential difference that brings about the electrospraying process.

By adhesively bonding the electrospray emitter conduit 24 into a sheath 28 made of conductive material such that a fluid-receiving back 24* of the emitter conduit 24 and the sheath 28 is flush, as illustrated in FIG. 2B, or such that the rear end of the emitter conduit 24 is slightly beveled or retracted into the sheath 28, as illustrated in the zoom-outs 40, 40*, respectively, a surface is created which can connect to a fluid-supplying capillary conduit 32 having a similar but opposing positioning in a jacket 34. In this manner, a connection with two butt connected conduits 24, 32 is created rendering any dead volume there-between as small as possible.

Figure 2C:
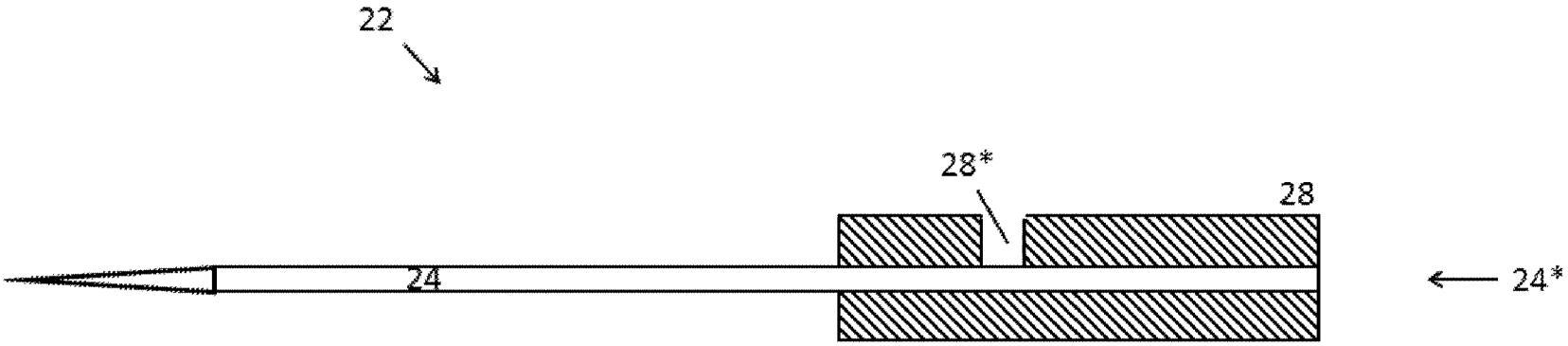
FIG. 2C illustrates a variant of an electrospray emitter assembled by gluing.

FIG. 2C presents a variant of the electrospray emitter 22 from FIGS. 2A and 2B. Instead of gluing the entrance end 24* of the electrospray emitter conduit 24 at its outer cylindrical surface with full-face contact to the inner cylindrical surface of the conductive sheath 28, it is possible to add a recess, such as a local perpendicular slit 28*, close to the forward face of the conductive sheath 28 opening up the axial channel with the fused silica conduit 24. If glue is applied there instead of directly at the rear face, contamination of the rear face, potentially close to the liquid junction which could cause issues with glue outgassing and shedding of small glue particulates, can be avoided. Compared to applying glue from the forward side (facing the emitter tip) of the conductive sheath 28, small tubular dead volumes can be avoided.

Figure 3:
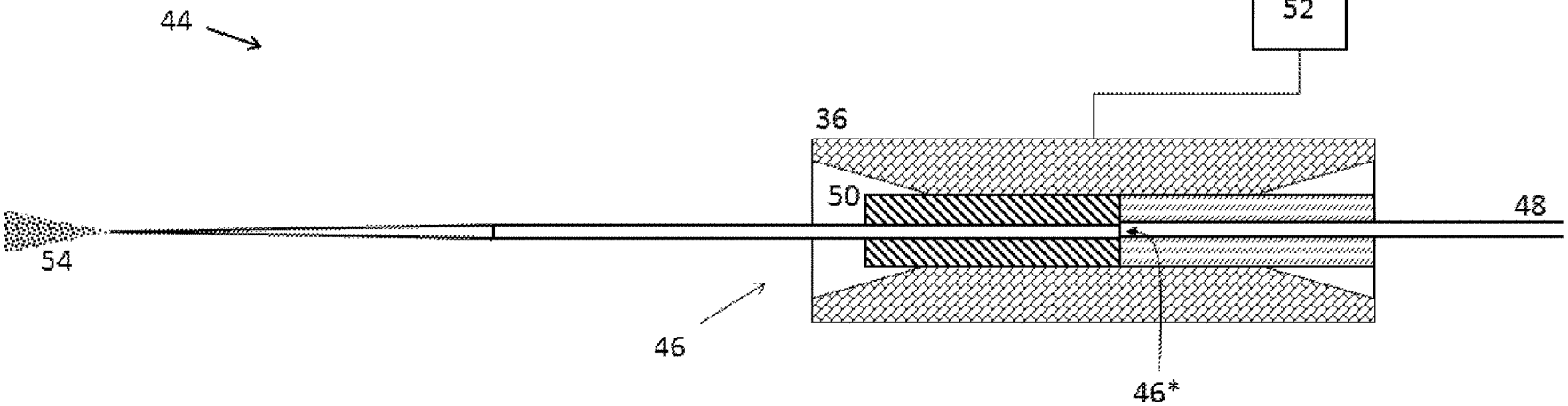
FIG. 3 shows a further exemplary embodiment of a liquid junction apparatus according to principles of the invention.

FIG. 3 illustrates, in analogy to FIGS. 2A and 2B, another example where a packed emitter 46 and a transfer line 48 are connected in a union 36 made of conductive material. As a liquid junction system 44 like the one depicted in FIG. 3 and also in the other figures can hold pressures up to the ultrahigh range (UHF ~1500 bar), the bonding of a conductive sheath 50 around a rear end 46* of a packed emitter 46 can be used to apply high voltage to this end 46* of the packed emitter 46 using a voltage source 52. This facilitates electrospraying 54 and ionizing sample molecules that may have been pre-separated analytically in an upstream substance separator, such as a liquid chromatograph or capillary electrophoresis device (not shown).

Figure 4A:
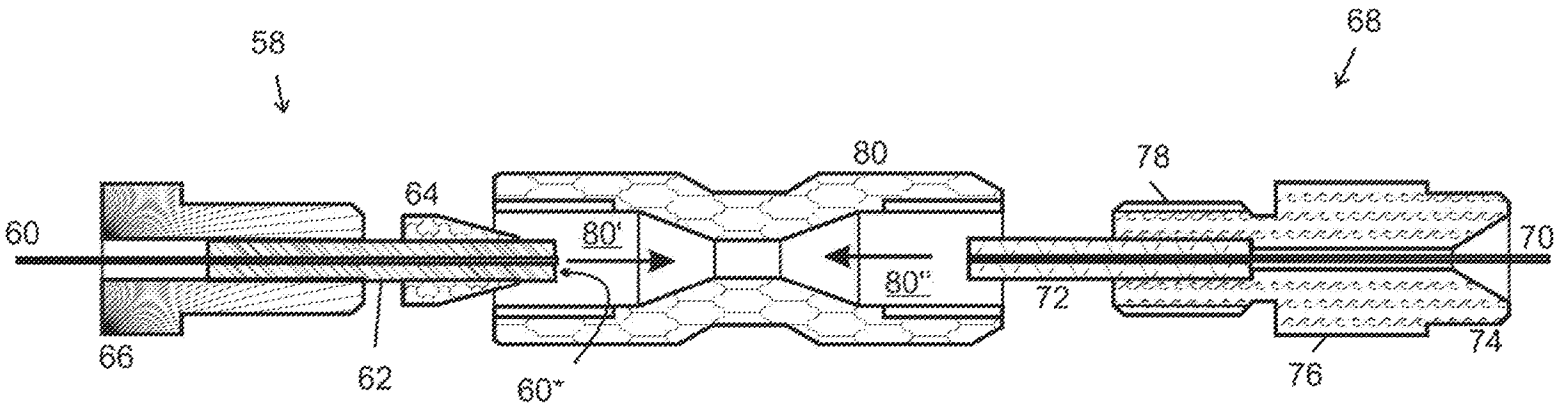
FIGS. 4A-4C present another exemplary embodiment of a liquid junction apparatus according to principles of the invention.
Figure 4C:
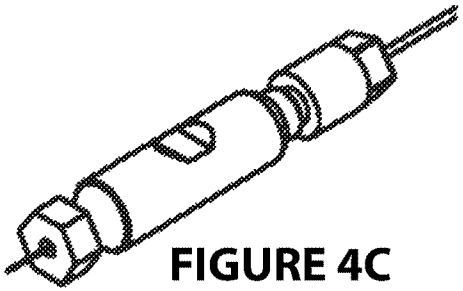
Figure 4B:
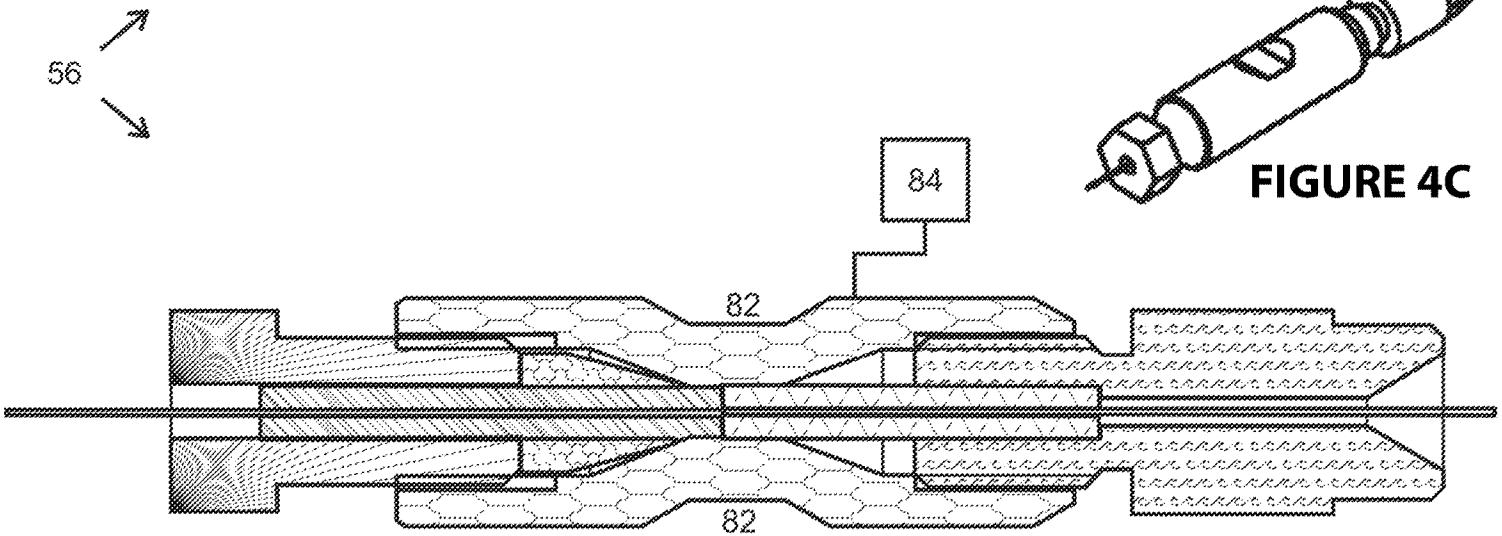

FIGS. 4A-4C present a further example of a liquid junction apparatus 56 for electrospray ionization, FIG. 4A being a cross-sectional view of the assembly in an unconnected state, FIG. 4B being a cross-sectional view of the assembly in a connected state and FIG. 4C being a schematic, isometric view of the assembly. An electrospray emitter 58 has an emitter conduit 60, such as a fused silica capillary conduit. The fused silica material renders the whole emitter conduit 60 from the liquid-entrance end 60* to the emitter tip (not shown) non-conductive in the example presented, or in other words virtually not capable of transmitting electrical charge carriers.

The liquid-entrance end 60* of the emitter conduit 60 is encased in a conductive sheath 62 which can take the form of conductive tubing, such as metal tubing (e.g. stainless steel tubing). The conductive sheath 62 is preferably attached to the emitter conduit 60 via the opposing inner and outer cylindrical surfaces, respectively, using an adhesive, such as glue. The adhesive facilitates a liquid-tight connection between emitter conduit 60 and conductive sheath 62.

In the present example, the electrospray emitter 58 further comprises a ferrule 64 mounted about the conductive sheath 62, for instance by adhesive or a crimp/friction fit, which can have a straight forward shoulder facing in the direction of an emitter tip (not shown; left-hand side of the figures) and a conically tapering portion facing in the opposite direction for fitting it into a first opening of a union to be described further below. The ferrule 64 can be made from a conductive material, such as metal, in order to assist establishing a conductive path from an outside voltage source to the liquid-carrying inside of the electrospray emitter 58. As will be understood by those skilled in the art, the ferrule 64 itself is not involved in sealing the fluid path. Rather, the sealing is effected at the interface plane where electrospray emitter 58 and capillary conduit assembly 68 abut in the union.

Further, a fixation nut 66 is foreseen which is designed and configured to partially accommodate and fix the electrospray emitter 58 via the ferrule 64 in the first opening of the union. The fixation nut 66 accommodates a part of the conductive sheath 62 in a dimensionally adapted through-bore while fixation can be brought about by interlocking means (not depicted) located at an outer circumference of a cylindrical portion to be partially inserted into the first opening of the union. A front face of the cylindrical portion may engage with the forward shoulder of the ferrule 64 upon insertion in order to press the ferrule 64 and the conductive sheath 62 and emitter conduit 60 attached thereto into the first opening so as to tighten the connection.

A capillary conduit assembly 68 for conducting liquid to be electrosprayed, in the example presented, comprises a capillary conduit 70. The capillary conduit assembly 68 moreover features a non-conductive jacket 72, made of PEEK or another suitable thermoplastic polymer, encasing an exit region of the capillary conduit 70. It may serve as a front face sealing element that seals against the rear face of the opposing conductive sheath 50 to form the desired butt joint and bottom sealing. The capillary conduit assembly 68 further comprises a manual handling member 74, which accommodates the jacket 72 and capillary conduit 70 and has an outer cylindrical gripping surface 76 and interlocking means 78, such as an outer thread, for stably securing it in a second opening of the union to be described below. In various implementations, the capillary conduit assembly 68 may be embodied by a bottom-sealing fitting known in the art, such as the nanoViper™ from Dionex Corporation, for instance.

The liquid junction apparatus exemplified in FIGS. 4A-C further have a union 80 which comprises an electrically conductive material. It can be completely made from metal, such as stainless steel, for instance. The union 80 here comprises optional outer circumferential indentations 82 configured for mounting a tool such as a wrench, and further has first and second sides, here facing away from one another. The first side with a first opening 80' accommodates the electrospray emitter 58 which can be inserted from the side with the conductive sheath 62 and the ferrule 64 head-on. The second side with a second opening 80" accommodates the capillary conduit assembly 68 which can likewise be inserted from the respective other side with the non-conductive jacket 72 and the manual handling member 74 head-on.

Each of the first and second openings 80', 80" includes an outer hollow-cylindrical entrance part which connects via a conically tapering part to a single straight hollow-cylindrical part at the center of the union 80 where the liquid-entrance end 60* of the electrospray emitter conduit 60 and the exit of the capillary conduit 70 meet. The electrospray emitter 58 and the capillary conduit assembly 68 can be locked in the outer hollow-cylindrical entrance parts of the first and second openings 80', 80", respectively, by an interlocking mechanism provided at the outer hollow-cylindrical parts, such as a screw joint including opposing mating threads as shown. Alternatively, a bayonet joint including a pin-like protrusion and a helical opposite guiding groove or other suitable means could be foreseen. When both the electrospray emitter 58 and the capillary conduit assembly 68 are fully inserted, they come to rest such that an exit of the capillary conduit 70 is positioned in opposing relation to the liquid-entrance end 60* of the electrospray emitter conduit 60 to form a butt joint providing for bottom sealing and thereby having low dead-volume.

The butt joint can be configured such that liquid, such as an eluent of an upstream substance separator (not shown), is transmitted from the capillary conduit assembly 68 to the electrospray emitter 58 while coming in electrical contact with the conductive sheath 62. This electrical contact between liquid and the conductive sheath 62 can be achieved in several ways as has been expounded in view of the embodiment in FIG. 2A above. Possible implementations comprise in particular (i) bonding the emitter conduit 60 to the surrounding conductive sheath 62 such that the emitter conduit 60 is slightly retracted into the conductive sheath 62, (ii) providing for a beveled end face of the emitter conduit 60, thereby facilitating partial contact of the contained liquid with the surrounding conductive sheath 62 at least, and (iii) arranging for the emitter conduit 60 and the conductive sheath 62 to be bonded flush, while at the same time providing the rear face of the emitter conduit 60 with a roughened surface, such as containing grooves and/or furrows, that allows liquid to creep from the interior of the conduit 60 up to the conductive sheath 62.

The union 80 is (or at least the conductive parts thereof are) connected to a voltage source 84 (as shown in FIG. 4B), and since the conductive sheath 62 is in electrical contact with the union 80, as the case may be via the conductive ferrule 64, as well as with the liquid being transmitted through the conduits 60, 70, the liquid at the butt joint between electrospray emitter 58 and capillary conduit assembly 68 is maintained at a predetermined electrical voltage level by operating the voltage source 84 to facilitate electrospraying. The voltage level can be at ground or any other suitable high voltage value, such as in the kilovolts range, which would then suggest a different voltage applied to a counter-electrode of the electrospray emitter 58 (not shown) to establish the potential difference that brings about the electrospraying process.

By adhesively bonding the electrospray emitter conduit 60 into a sheath 62 made of conductive material such that a fluid-receiving back 60* of the emitter conduit 60 and the sheath 62 is flush, as illustrated in FIG. 4B, or such that the rear end of the emitter conduit 60 is slightly retracted into the sheath 62 (not illustrated), a surface is created which can connect to a fluid-supplying capillary conduit 70 having a similar but opposing positioning in a jacket 72. In this manner, a connection with two butt connected conduits 60, 70 is created rendering any dead volume there-between as small as possible.

Figure 5C:
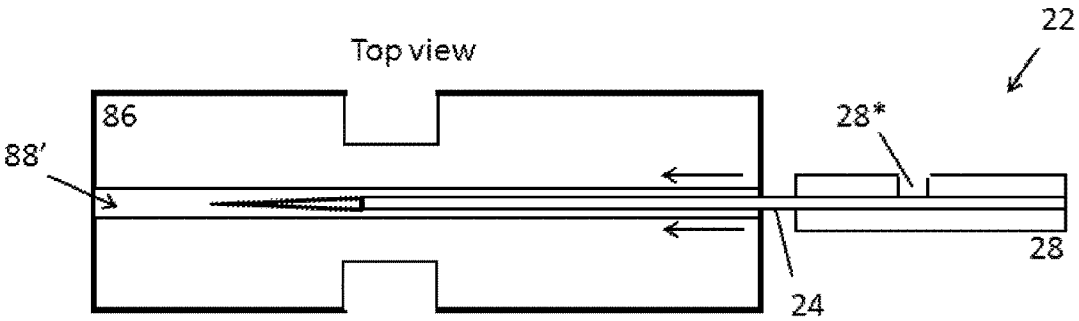
FIGS. 5A-5E show yet another exemplary embodiment of a liquid junction apparatus according to principles of the invention.
Figure 5B:
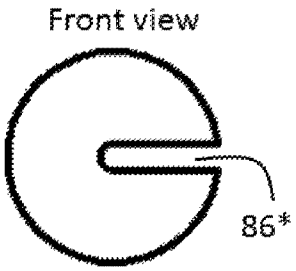
Figure 5A:
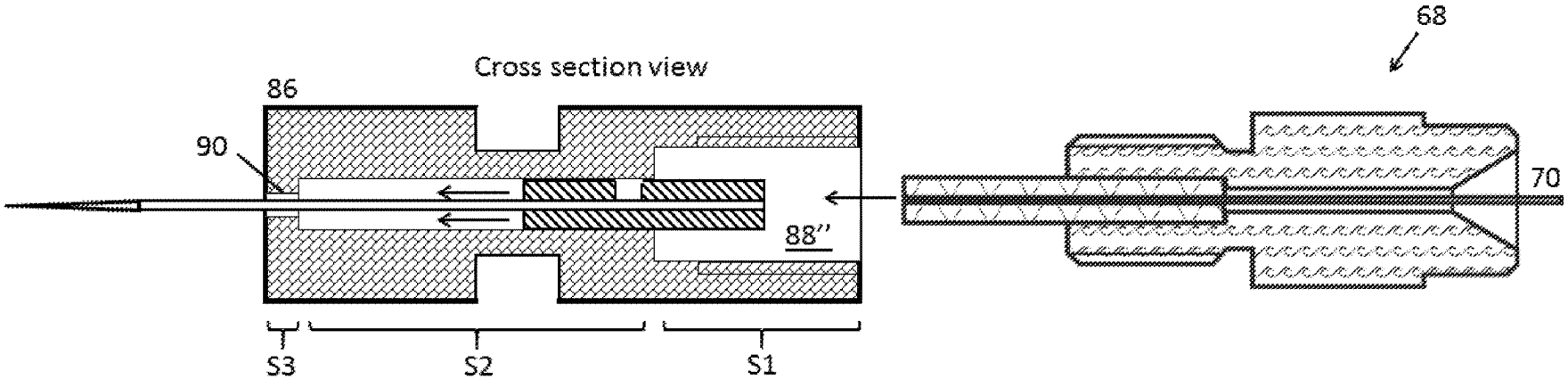
Figure 5D:
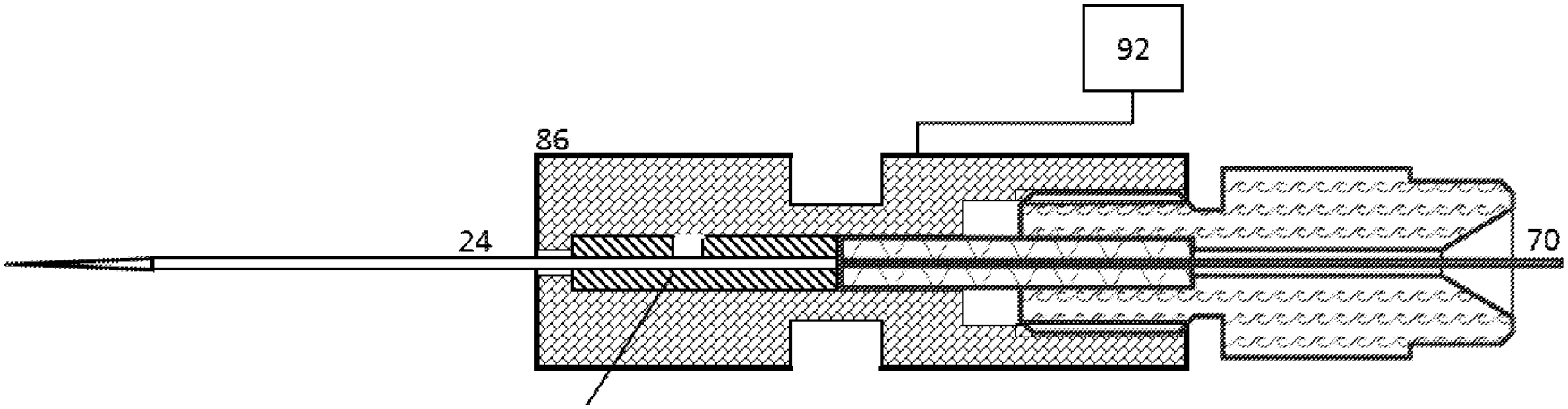
Figure 5E:
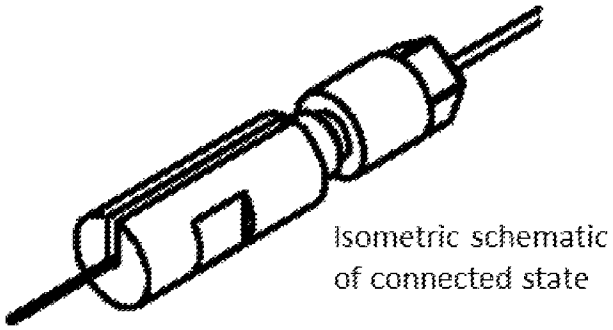

The embodiment shown in FIGS. 5A-5E includes an electrospray emitter 22 with a local perpendicular slit 28* in the conductive sheath 28 for the application of glue, and is similar to the one illustrated in FIG. 2C so that the description will not be reiterated here. It further includes a standard bottom-sealing fitting as the capillary conduit assembly 68, such as a nanoViper™ from Dionex Corporation as has been explained with reference to FIGS. 4A-4C. The differences to previous embodiments manifest themselves in the structure of the union 86 and the establishing of the connection which will be set out below. FIG. 5A is a cross-sectional view of the assembly in an unconnected state, FIG. 5B is a front view of the union 86, FIG. 5C is a top view of the union 86 and the emitter 22, FIG. 5D is a cross-sectional view of the assembly in a connected state and FIG. 5E is a schematic, isometric view of the connected state.

In the present example, the union 86, which may again be fully metallic, comprises a slit 86* which extends along its entire length and provides access to the inner cavities and cut-outs hidden therein. The width of the slit 86* facilitates lateral insertion and withdrawal of a dimensionally adapted electrospray emitter conduit 24 ending in an emitter tip. The slit 86* can have a width of half a millimeter at least, for instance, in order to be able to accept standard fused silica conduits featuring typical outer diameters of 150, 280, or 360 micrometers.

The interior of the union 86 is designed and configured with three hollow-cylindrical sections S1, S2, S3 of stepwise decreasing inner diameter from the second opening 88" to the first opening 88' such that the first opening 88' is confined radially by an inward-reaching shoulder 90 dimensioned such as to facilitate neat accommodation of the electrospray emitter conduit 24. Moreover, the shoulder 90 provides for an inward-facing contact surface with which a front face of the conductive sheath 28 engages when the electrospray emitter 22 has been fully inserted into and fixed within the union 86.

Insertion comprises threading-in a downstream bare portion of the electrospray emitter conduit 24 close to the emitter tip while the bulkier section encompassing the conductive sheath 28 comes to lie outside substantially opposite the second opening 88" of the union, intended actually for receiving the bottom-sealing fitting 68. Then, the electrospray emitter 22 is drawn into the union 86 towards the first opening 88' and passes the sections S1 and S2 until the front face of the conductive sheath 28 engages with and comes to rest at the inward-reaching shoulder 90, as shown in the fully connected state in FIG. 5D. In order that the electrospray emitter sits tightly and fixed in this position, the capillary conduit assembly 68 can be likewise inserted into the second opening 88" where it may be locked by means of mating outer and inner screw threads, as has been indicated before. In this manner, a butt joint and bottom sealing are established between the capillary conduit 70 and the electrospray emitter conduit 24.

The union 86 is (or at least the conductive parts thereof are) connected to a voltage source 92, and since the conductive sheath 28 is in electrical contact with the union 86 as well as the liquid being transmitted through the conduits 24, 70, the liquid at the butt joint between electrospray emitter 22 and capillary conduit assembly 68 is maintained at a predetermined electrical voltage level by operating the voltage source 92 to facilitate electrospraying. The voltage level can be at ground or any other suitable high voltage value, such as in the kilovolts range, which would then suggest a different voltage applied to a counter-electrode of the electrospray emitter 22 to establish the potential difference that brings about the electrospraying process.

The invention has been shown and described with reference to a number of different embodiments thereof. It will be understood, however, that various aspects or details of the invention may be changed, or various aspects or details of different embodiments may be arbitrarily combined, if practicable, without departing from the scope of the invention. Generally, the foregoing description is for the purpose of illustration only, and not for the purpose of limiting the invention which is defined solely by the appended claims.

What is claimed is:

1. A liquid junction apparatus for electrospray ionization, comprising:

an electrospray emitter having a liquid-entrance end which is fluidly connected via an electrospray emitter conduit to an emitter tip, from which liquid can be electrosprayed, the liquid-entrance end comprising an encasing with a conductive sheath, a capillary conduit assembly for conducting liquid to be electrosprayed that bottom-seals against the conductive sheath, and a union comprising an electrically conductive material and having a first side and a second side, the first side being designed and configured with a first opening to partially accommodate the electrospray emitter and the second side being designed and configured with a second opening to accommodate the capillary conduit assembly such that an exit of the capillary conduit assembly is positioned in opposing relation to the liquid-entrance end of the electrospray emitter to form a butt joint which facilitates transmitting liquid from the capillary conduit assembly to the electrospray emitter such that electrical contact of the liquid with the conductive sheath is established, wherein the union is connected to a voltage source and the conductive sheath is in electrical contact with the union such that the liquid at the butt joint is maintained at a predetermined electrical voltage level to facilitate electrospraying.

2. The liquid junction apparatus of claim 1, wherein the capillary conduit assembly comprises a capillary column.

3. The liquid junction apparatus of claim 1, wherein the capillary conduit assembly comprises a transfer line and the electrospray emitter comprises a packed emitter assembly including a capillary column.

4. The liquid junction apparatus of claim 1, wherein the butt joint encompasses a slight gap between the exit of the capillary conduit assembly and the liquid-entrance end of the electrospray emitter conduit so as to facilitate the electrical contact of liquid with the conductive sheath.

5. The liquid junction apparatus of claim 4, wherein the gap is defined by one of a beveled liquid-entrance end of the electrospray emitter conduit, and by the electrospray emitter conduit being slightly retracted into the surrounding conductive sheath.

6. The liquid junction apparatus of claim 1, wherein the conductive sheath comprises conductive tubing.

7. The liquid junction apparatus of claim 1, wherein the conductive sheath is made from metal.

8. The liquid junction apparatus of claim 1, wherein the liquid-entrance end of the electrospray emitter conduit engages with and is adhesively bonded to the conductive sheath.

9. The liquid junction apparatus of claim 1, wherein the conductive sheath encases the liquid-entrance end of the electrospray emitter conduit one of flush and slightly protruding therefrom.

10. The liquid junction apparatus of claim 1, wherein the capillary conduit assembly comprises a non-conductive jacket encasing an exit region of a capillary conduit.

11. The liquid junction apparatus of claim 1, wherein at least one of the electrospray emitter and the capillary conduit assembly can be inserted into and withdrawn from the first and second opening, respectively, head-on.

12. The liquid junction apparatus of claim 11, wherein the electrospray emitter further comprises a ferrule mounted about the conductive sheath, and further comprising a fixation nut which is designed and configured to partially accommodate and fixate the electrospray emitter in the first opening of the union via pressurizing the ferrule.

13. The liquid junction apparatus of claim 1, wherein at least one of the first and second openings comprises an interlocking mechanism which encompasses a screw joint or bayonet joint.

14. The liquid junction apparatus of claim 1, wherein the electrospray emitter conduit comprises a fused silica capillary.

15. The liquid junction apparatus of claim 1, wherein the union comprises a slit extending along its entire length, the width of which facilitates lateral insertion and withdrawal of the electrospray emitter conduit.

16. The liquid junction apparatus of claim 15, wherein the first opening is confined radially by a shoulder dimensioned such as to facilitate neat accommodation of the electrospray emitter conduit, and wherein the shoulder provides for a contact surface with which a front face of the conductive sheath engages when the electrospray emitter has been inserted into the union.

17. The liquid junction apparatus of claim 1, wherein the capillary conduit assembly is connected upstream to a substance separator in order to receive sample liquid therefrom.

18. The liquid junction apparatus of claim 17, wherein the substance separator is one of a liquid chromatograph and a capillary electrophoresis device.

19. The liquid junction apparatus of claim 1, wherein the union is made from a conductive material.

20. A mass spectrometer having an electrospray ionization source which is supplied with a sample liquid via a liquid junction apparatus according to claim 1.

* * * * *